United States Patent [19]

Muench et al.

[11] Patent Number: 4,925,103

[45] Date of Patent: May 15, 1990

[54] MAGNETIC FIELD-GENERATING NOZZLE FOR ATOMIZING A MOLTEN METAL STREAM INTO A PARTICLE SPRAY

[75] Inventors: George J. Muench, Hamden; Brian G. Lewis, Branford; Sankaranarayanan Ashok, Bethany; William G. Watson, Cheshire; Harvey P. Cheskis, North Haven, all of Conn.

[73] Assignee: Olin Corporation, Cheshire, Conn.

[21] Appl. No.: 322,433

[22] Filed: Mar. 13, 1989

[51] Int. Cl.[5] ..... B05B 1/02

[52] U.S. Cl. ..... 239/79; 239/602; 118/300; 118/623

[58] Field of Search ..... 239/1, 79, 85, 102.2, 239/602; 118/623

[56] References Cited

U.S. PATENT DOCUMENTS

| | | | |
|---|---|---|---|
| Re. 31,767 | 12/1984 | Brooks | 29/527.2 |
| 2,559,351 | 7/1951 | Drake et al. | 117/38 |
| 2,972,185 | 2/1961 | Brennan | 29/420.5 |
| 3,131,091 | 4/1964 | Jones | 118/623 |
| 3,608,615 | 9/1971 | Conlon | 164/87 |
| 3,727,672 | 4/1973 | Grenfell | 164/281 |
| 3,742,585 | 7/1973 | Wentzell | 29/423 |
| 3,775,156 | 11/1973 | Singer | 117/65.2 |
| 3,826,301 | 7/1974 | Brooks | 164/46 |
| 3,909,921 | 10/1975 | Brooks | 29/527.2 |
| 3,979,756 | 9/1976 | Helinski et al. | 239/102.2 X |
| 4,512,384 | 4/1985 | Sendzimir | 164/46 |
| 4,546,815 | 10/1985 | Liebermann et al. | 164/463 |
| 4,582,117 | 4/1986 | Kushnick | 164/463 |
| 4,588,021 | 5/1986 | Bergeron et al. | 164/432 |
| 4,642,130 | 2/1987 | Hargreaves et al. | 65/60.1 |
| 4,721,154 | 1/1988 | Christ et al. | 164/452 |

FOREIGN PATENT DOCUMENTS

| | | |
|---|---|---|
| 1379261 | 2/1975 | United Kingdom . |
| 1472939 | 5/1977 | United Kingdom . |
| 2007129 | 5/1979 | United Kingdom . |
| 1548616 | 7/1979 | United Kingdom . |
| 1599392 | 9/1981 | United Kingdom . |
| 2172827 | 10/1986 | United Kingdom . |
| 2172900 | 10/1986 | United Kingdom . |
| 0225732 | 6/1987 | United Kingdom . |
| 0225080 | 10/1987 | United Kingdom . |

OTHER PUBLICATIONS

R. W. Evans et al, "The Osprey Preform Process", 1985, pp. 13–20 *Powder Metallurgy*, vol. 28, No. 1.

A. G. Leatham et al, "The Osprey Process for the Production of Spray-Deposited Roll, Disc, Tube and Billet Preforms", 1985, pp. 157–173, *Modern Developments in Powder Metallurgy*, vols. 15–17.

*Primary Examiner*—Andres Kashnikow
*Assistant Examiner*—William A. Grant
*Attorney, Agent, or Firm*—H. Samuel Kieser

[57] ABSTRACT

A molten metal spray-depositing apparatus employs a magnetic field-generating nozzle for atomizing a molten metal stream into a spray of metal particles. The magnetic driving field generated by the magnetic atomizing nozzle generates eddy currents which produce an induced field in the metal stream opposing the driving field and creating a torque which causes the stream to break up upon exiting the driving field. The nozzle has one of two configurations for generating one of two generic magnetic field geometries. In one configuration the nozzle utilizes a pair of spaced magnetic poles, such as provided by Helmholtz coils, for generating a transverse magnetic field geometry across the stream. In the other configuration the nozzle employs a solenoid coil for generating a solenoidal magnetic field geometry parallel to the stream. Preferably, the magnetic field of each geometry is a high frequency AC field since better coupling between the field and stream occurs and more eddy currents are induced at higher frequency.

18 Claims, 2 Drawing Sheets

MAGNETIC FIELD-GENERATING NOZZLE FOR ATOMIZING A MOLTEN METAL STREAM INTO A PARTICLE SPRAY

The present invention generally relates to metal particle spray-deposited production of a product and, more particularly, is concerned with a magnetic field-generating nozzle for atomizing a molten metal stream into a spray of metal particles.

A commercial process for production of spray-deposited, shaped preforms in a wide range of alloys has been developed by Osprey Metals Ltd. of West Glamorgan, United Kingdom. The Osprey process, as it is generally known, is disclosed in detail in U.K. Pat. Nos. 1,379,261 and 1,472,939 and U.S. Pat. Nos. 3,826,301 and 3,909,921 and in publications entitled "The Osprey Preform Process" by R.W. Evans et al., *Powder Metallurgy,* Vol. 28, No. 1 (1985), pages 13–20 and "The Osprey Process for the Production of Spray-Deposited Roll, Disc, Tube and Billet Preforms" by A.G. Leatham et al., *Modern Developments in Powder Metallurgy,* Vols. 15–17 (1985), pages 157–173.

The Osprey process is essentially a rapid solidification technique for the direct conversion of liquid metal into shaped preforms by means of an integrated gas-atomizing/spray-depositing operation. In the Osprey process, a controlled stream of molten metal is poured into a gas-atomizing device where it is impacted by high-velocity jets of gas, usually nitrogen or argon. The resulting spray of metal particles is directed onto a "collector" where the hot particles re-coalesce to form a highly dense preform. The collector is fixed to a mechanism which is programmed to perform a sequence of movements within the spray, so that the desired preform shape can be generated. The preform can then be further processed, normally by hot-working, to form a semi-finished or finished product.

The Osprey process has also been proposed for producing strip or plate or spray-coated strip or plate, as disclosed in U.S. Pat. No. 3,775,156 and European Pat. Appln. No. 225,080. For producing these products, a substrate or collector, such as a flat substrate or an endless belt, is moved continuously through the spray to receive a deposit of uniform thickness across its width.

In the Osprey process, the gas-atomizing jets break up the molten metal stream and produce the spray of metal particles by impact from high pressure gas flows. It is thought that the ultrasonic shock wave of these gas flows is responsible for disrupting the melt stream and causing droplet or particle formation. A problem with this technique is the amount of gas necessary to cause droplet formation. This great quantity of gas requires expensive gas handling equipment. Furthermore, gas flows away from the melt stream carry away small droplets of metal. These small particles in the exhaust gas reduce process yield and remove what are potentially the most useful component. Additionally, the gas may result in porosity in the final product.

Therefore, a need exists for an alternative approach for producing break-up of the molten metal stream into a particle spray which avoids the problems associated with gas atomization.

The present invention provides a magnetic field-generating atomizing nozzle designed to satisfy the aforementioned needs. Magnetic field generated by the nozzle of the present invention are used to destabilize the molten metal stream so as to cause atomization thereof. The magnetic driving field generated by the magnetic atomizing nozzle generates eddy currents which produce an induced field in the metal stream opposing the driving field and creating a torque which causes the stream to break up upon exiting the driving field.

The advantages of non-gaseous magnetic field atomization are both economic (no gas costs) and technical (no loss of fine particles via entrapment in the gas flow and elimination of the porosity in the final product due to the use of gas). Further, since magnetic interactions with liquid metal sheets are geometrically favored the construction of a slotted nozzle for magnetically atomizing the melt stream would preclude the need to oscillate/precess conventional gas-atomizing nozzles to optimize coverage and compaction.

In accordance with the present invention, there are two configurations of the magnetic atomizing nozzle for generating two generic magnetic field geometries. In one configuration, the nozzle utilizes a pair of spaced magnetic poles, such as provided by Helmholtz coils, for generating a transverse magnetic field geometry across the stream. In the other configuration, the nozzle employs a solenoid for generating a solenoidal magnetic field geometry generally parallel to the stream.

Preferably, the magnetic field of each geometry is a high frequency AC field since better coupling between the field and stream occurs and more eddy currents are induced at higher frequency.

Further, in accordance with the present invention, the two generic magnetic field geometries generated by the two nozzle configurations can be used in tandem. Also, variations on either field geometry can be obtained by choosing pole geometry and/or winding patterns.

These and other features and advantages of the present invention will become apparent to those skilled in the art upon a reading of the following detailed description when taken in conjunction with the drawings wherein there is shown and described an illustrative embodiment of the invention.

In the course of the following detailed description, reference will be made to the attached drawings in which.

Figure 1:
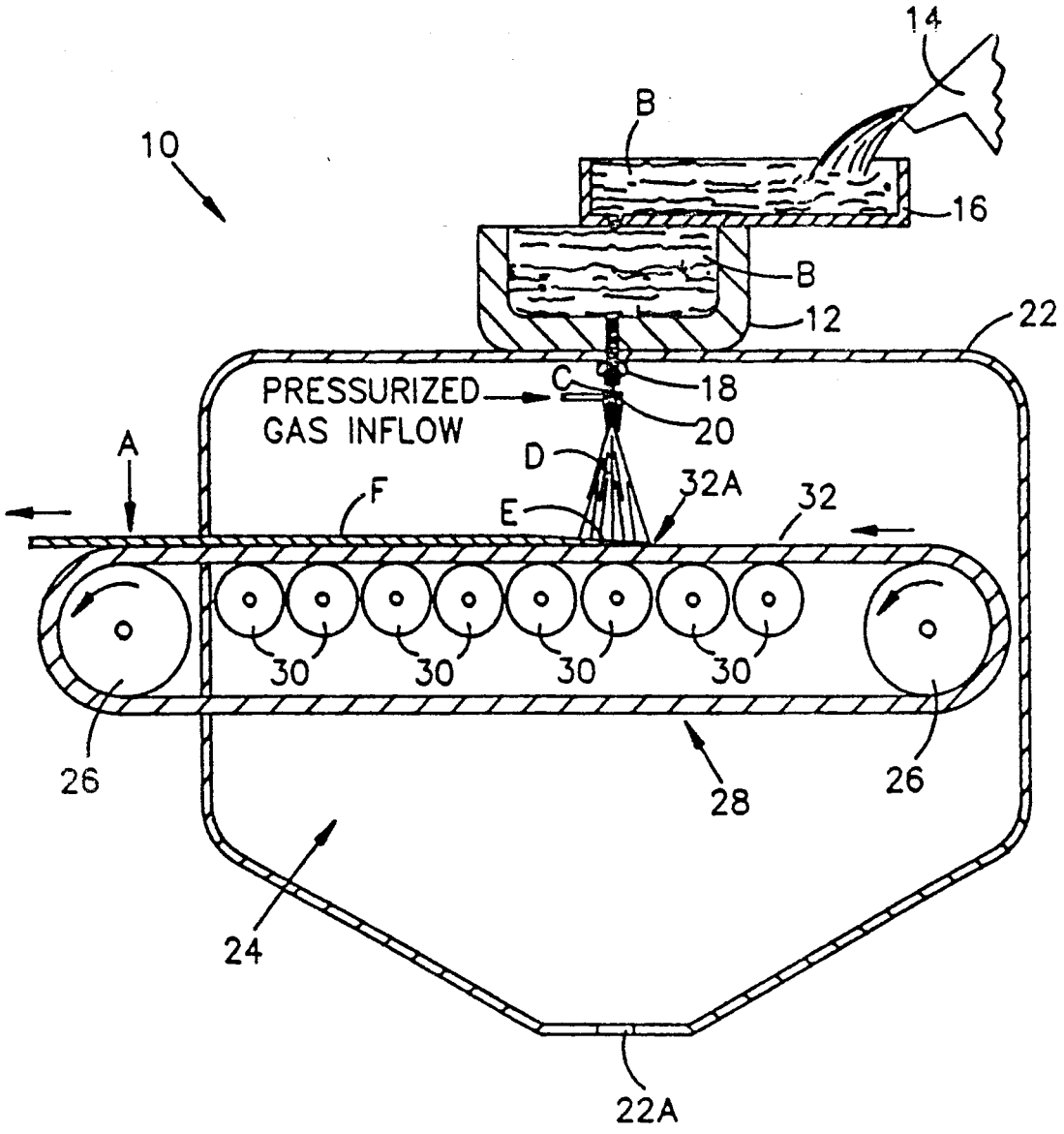
PRIOR ART FIG-1
FIG. 1 is a schematic view, partly in section, of a prior art spray-deposition apparatus for producing a product on a moving substrate, such as in thin gauge strip form.

Referring now to the drawings, and particularly to FIG. 1, there is schematically illustrated a prior art spray-deposition apparatus, generally designated by the numeral 0, being adapted for continuous formation of products. An example of a product A is a thin gauge metal strip. One example of a suitable metal B is a copper alloy.

The spray-deposition apparatus 10 employs a tundish 12 in which the metal B is held in molten form. The tundish 12 receives the molten metal B from a tiltable melt furnace 14, via a transfer launder 16, and has a bottom nozzle 18 through which the molten metal B issues in a stream C downwardly from the tundish 12.

Also, a gas-atomizer 20 employed by the apparatus 10 is positioned below the tundish bottom nozzle 18 within a spray chamber 22 of the apparatus 10. The atomizer 20 is supplied with a gas, such as nitrogen, under pressure from any suitable source. The atomizer 20 which surrounds the molten metal stream C impinges the gas on the stream C so as to convert the stream into a spray D of atomized molten metal particles. The particles broadcast downwardly from the atomizer 20 in the form of a divergent conical pattern. If desired, more than one atomizer 20 can be used. Also, the atomizer(s) can be moved transversely in side-to-side fashion for more uniformly distributing the molten metal particles.

Further, a continuous substrate system 24 employed by the apparatus 10 extends into the spray chamber 22 in generally horizontal fashion and in spaced relation below the gas atomizer 20. The substrate system 24 includes drive means in the form of a pair of spaced rolls 26, an endless substrate 28 in the form of a flexible belt entrained about and extending between the spaced rolls 26, and support means in the form of a series of rollers 30 which underlie and support an upper run 32 of the endless substrate 28. The substrate 28 is composed of a suitable material, such as stainless steel. An area 32A of the substrate upper run 32 directly underlies the divergent pattern of spray D for receiving thereon a deposit E of the atomized metal particles to form the metal strip product A.

The atomizing gas flowing from the atomizer 20 is much cooler than the solidus temperature of the molten metal B in the stream C. Thus, the impingement of atomizing gas on the spray particles during flight and subsequently upon receipt on the substrate 28 extracts heat therefrom, resulting in lowering of the temperature of the metal deposit E below the solidus temperature of the metal B to form the solid strip F which is carried from the spray chamber 22 by the substrate 28 from which it is removed by a suitable mechanism (not shown). A fraction of the particles overspray the substrate 28, solidify and fall to the bottom of the spray chamber 22 where they along with the atomizing gas flow from the chamber via an exhaust port 22A.

One problem with using the prior art technique of gas atomization to convert the molten metal stream C into the metal particle spray D is the large amount of gas necessary to cause droplet or particle formation. This great quantity of gas requires expensive gas handling equipment. Furthermore, gas flows away from the melt stream carry away small droplets of metal. These small particles in the exhaust gas reduce process yield and remove what are potentially the most useful component.

The solution of the present invention is to employ a magnetic field-generating device instead of the spray atomizer 20 for atomizing or breaking up the molten metal stream C into the metal particle spray D. The magnetic driving field generated by the magnetic atomizing device generates eddy currents in the melt stream C which produce an induced field in the stream opposing the driving field and creating a torque which causes the stream to break up upon exiting the driving field.

Figure 2:
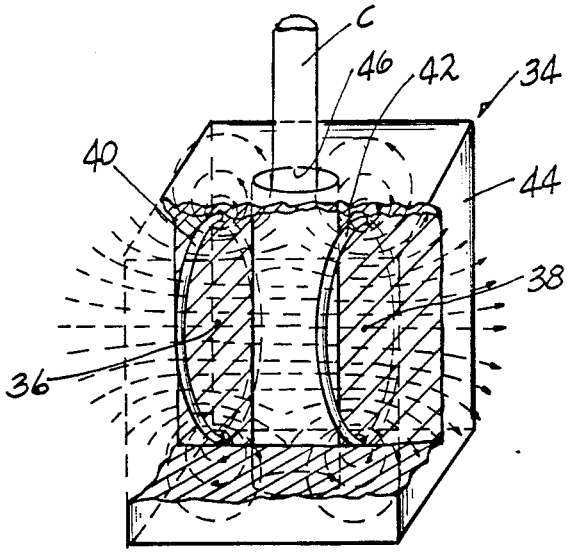
FIG. 2 is a fragmentary schematic view, partly in section, of one modified form of the spray-deposition apparatus employing a first configuration of a magnetic atomizing nozzle for generating a first magnetic field geometry in accordance with the present invention.
Figure 3:
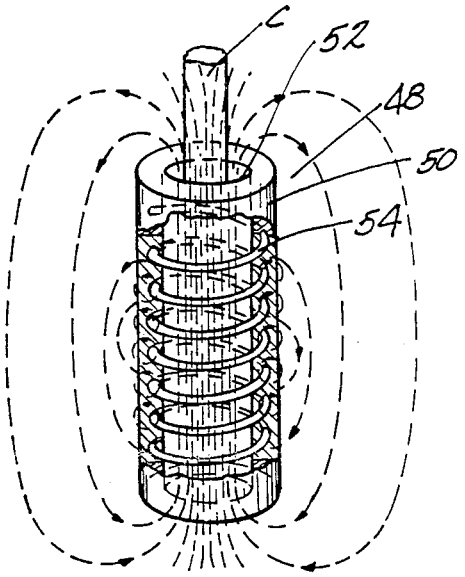
FIG. 3 is a fragmentary schematic view, partly in section, of another modified form of the spray-deposition apparatus employing a second configuration of a magnetic atomizing nozzle for generating a second magnetic field geometry in accordance with the present invention.

Referring now to FIGS. 2 and 3, in accordance with the present invention there are schematically illustrated two different configurations of the device for generating two generic magnetic field geometries which each impose a body force, e.g., a torque, on the molten metal stream C to cause break-up of the stream into the spray D of metal particles. In the one configuration of FIG. 2, the device is a magnetic atomizing nozzle 34 which utilizes a pair of spaced magnetic poles 36, 38. For example, the poles 36, 38 are defined by Helmholtz coils 40, 42 supported by a nozzle body 44 and located at a pair of opposite sides of the body. The nozzle body 44 has an orifice 46 which receives the stream C therethrough and the coils 40, 42 located at opposite sides of the orifice 46 generate a magnetic field G between the poles 36, 38 of transverse geometry extending across the stream C and body orifice 46.

In the other configuration of FIG. 3, the device is a magnetic atomizing nozzle 48 which has a body 50 with an orifice 52 the same as the nozzle 34. The nozzle 48 employs a solenoid coil 54 supported by the body 50 in surrounding relation to the orifice 52 for generating a magnetic field H of solenoidal geometry extending parallel to the stream C and through the body orifice 52.

The break-up mechanism of the two fields G and H is that of a body force which breaks (negatively accelerates) the melt stream. Any field shape which permits the melt stream to start from a zero field region and enter a region with a magnetic field will do this somewhat. Since the melt stream is moving, even a static field will work minimally.

The important difference between the transverse and solenoidal field G and H is in orientation of induced eddy currents. The eddy currents will produce an induced field which opposes the driving field. Thus, a transverse driving field G will produce eddy currents whose normal is perpendicular to the melt stream. This is probably somewhat inefficient for coupling between the field and stream but will result in some torque. The solenoidal driving field H will produce eddy currents whose normal is along the melt stream. This will probably produce the better coupling of the two basic geometries.

Preferably, the magnetic field of each geometry is a high frequency AC field since better coupling between the field and stream occurs and more eddy currents are induced at higher frequency. As mentioned above, a static magnetic field will cause some breaking action since the melt stream is moving. However since power (and coupling) are functions of frequency, it is more helpful to achieving the objective of stream break-up to deliver an AC field.

For a high delivered power, it is necessary to run at a high frequency. Similarly more eddy currents are induced at higher frequency. Finally, coupling of an electromagnetic wave to a conductor is a function of electromagnetic frequency and conductor size/geometry.

However, the desired process has a large distribution in both size and geometry. It starts with a large infinite cylinder and winds up with small spheres. To provide for efficient use of the electromagnetic field, it may be useful to chirp (pulse) the frequency of the signal.

Figure 4:
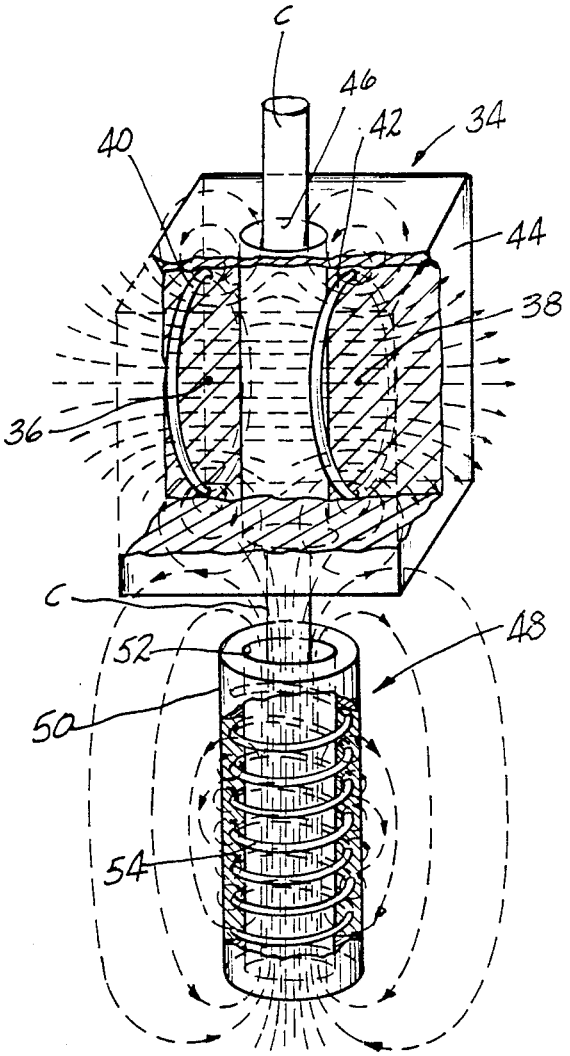
FIG. 4 is a fragmentary schematic view, partly in section, of still another modified form of the spray-deposition apparatus employing a tandem arrangement of the first and second nozzle configurations.

Variations on either field geometry can be obtained by choosing pole geometry and/or winding patterns. Also, as seen in FIG. 4, the two generic magnetic field geometries G, H generated by the configurations of the two nozzles 34, 48 can be used in tandem.

It is thought that the present invention and many of its attendant advantages will be understood from the foregoing description and it will be apparent that various changes may be made in the form, construction and arrangement of the parts thereof without departing from the spirit and scope of the invention or sacrificing all of its material advantages, the form hereinbefore described being merely a preferred or exemplary embodiment thereof.

What is claimed:

1. In a molten metal spray-depositing apparatus, the combination comprising:

(a) means for producing a stream of molten metal; and (b) means for generating a magnetic field in a predetermined geometry relative to the molten metal stream to induce a torque in the stream which results in atomizing of the molten metal of the stream into a spray of metal particles when the stream exits said field.

2. The apparatus as recited in claim 1, wherein magnetic field of said predetermined geometry is a high frequency AC field.

3. The apparatus as recited in claim 1, wherein said magnetic field-generating means is a magnetic atomizing nozzle.

4. The apparatus as recited in claim 3, wherein said magnetic atomizing nozzle has a configuration utilizing a pair of spaced magnetic poles for generating a transverse magnetic field geometry.

5. The apparatus as recited in claim 4, wherein said nozzle has a body with an orifice for receiving the stream therethrough, said pair of poles of said nozzle being defined by Helmholtz coils supported by said body at opposite sides of said orifice.

6. The apparatus as recited in claim 3, wherein said magnetic atomizing nozzle has a configuration utilizing a solenoid coil for generating a solenoidal magnetic field geometry.

7. The apparatus as recited in claim 6, wherein said nozzle has a body with an orifice for receiving the stream therethrough, said solenoid coil being supported by said body and surrounding said orifice.

8. The apparatus as recited in claim 1, wherein said magnetic field-generating means is a pair of magnetic atomizing nozzles arranged in tandem one above the other for generating magnetic fields of different predetermined geometries.

9. The apparatus as recited in claim 8, wherein magnetic field of each geometry is a high frequency AC field.

10. The apparatus as recited in claim 8, wherein one of said magnetic atomizing nozzles has a configuration utilizing a pair of spaced magnetic poles for generating a transverse magnetic field geometry.

11. The apparatus as recited in claim 10, wherein said one nozzle has a body with an orifice for receiving the stream therethrough, said pair of poles of said nozzle being defined by Helmholtz coils supported by said body at opposite sides of said orifice.

12. The apparatus as recited in claim 8, wherein the other of said magnetic atomizing nozzles has a configuration utilizing a solenoid coil for generating a solenoidal magnetic field geometry.

13. The apparatus as recited in claim 12, wherein said other nozzle has a body with an orifice for receiving the stream therethrough, said solenoid coil being supported by said body and surrounding said orifice.

14. In a molten metal spray-depositing apparatus, the combination comprising:

(a) means for producing a stream of molten metal; and (b) a magnetic atomizing nozzle for generating a magnetic field in a predetermined geometry relative to the molten metal stream to induce a torque in the stream which results in atomizing of the molten metal of the stream into a spray of metal particles when the stream exits said field, said magnetic field of said predetermined geometry being a high frequency AC field.

15. The apparatus as recited in claim 14, wherein said magnetic atomizing nozzle has a configuration utilizing a pair of spaced magnetic poles for generating a transverse magnetic field geometry.

16. The apparatus as recited in claim 15, wherein said nozzle has a body with an orifice for receiving the stream therethrough, said pair of poles of said nozzle being defined by Helmholtz coils supported by said body at opposite sides of said orifice.

17. The apparatus as recited in claim 15, wherein said magnetic atomizing nozzle has a configuration utilizing a solenoid coil for generating a solenoidal magnetic field geometry.

18. The apparatus as recited in claim 17, wherein said nozzle has a body with an orifice for receiving the stream therethrough, said solenoid coil being supported by said body and surrounding said orifice.

* * * * *